US006308924B1

(12) United States Patent
Janesky

(10) Patent No.: US 6,308,924 B1
(45) Date of Patent: Oct. 30, 2001

(54) PUMP STAND FOR SUMP PUMP CONTAINER

(76) Inventor: Lawrence M. Janesky, 11 Fawn Meadow La., Huntington, CT (US) 06484

( * ) Notice: Subject to any disclaimer, the term of this patent is extended or adjusted under 35 U.S.C. 154(b) by 0 days.

(21) Appl. No.: 09/557,595

(22) Filed: Apr. 24, 2000

(51) Int. Cl.[7] ..... A47B 91/00
(52) U.S. Cl. ..... 248/346.01; 248/909; 248/548
(58) Field of Search ..... 248/548, 909, 248/152, 346.01, 127

(56) References Cited

U.S. PATENT DOCUMENTS 4,057,366 * 11/1977 Niemann ..... 417/234
4,333,573 * 6/1982 Holoubek ..... 211/11
4,984,848 * 1/1991 Scalisi et al. ..... 297/440
4,986,499 * 1/1991 Ponticelli ..... 248/27.1
5,314,313 * 5/1994 Janesky ..... 417/63
5,501,044 * 3/1996 Janesky ..... 52/169.5
5,927,955 * 7/1999 Janesky ..... 417/423.3

* cited by examiner

*Primary Examiner*—Anita King
*Assistant Examiner*—Kimberly Wood
(74) *Attorney, Agent, or Firm*—Perman & Green, LLP

(57) ABSTRACT

A stand for supporting sump pumps within a sump container at an elevation above the floor of the container, having an out-of-round somewhat-circular platform having a weakened partition line for breaking or cutting the platform into two similar somewhat semi-circular half-platforms. The platform has a plurality of spaced peripheral legs fastened thereto and a plurality of closely-spaced central legs fastened to the undersurface adjacent the center thereof, whereby the stand can support two sump pumps, side-by-side, above the floor of the container and to avoid any clogging of the pumps with dirt or mud present on the container floor. The platform can be divided along the partition line to produce two similar stackable half-stands, each half-stand having at least two peripheral legs and at least one central leg for supporting a single sump pump within a sump container adjacent the interior wall thereof.

7 Claims, 4 Drawing Sheets

PUMP STAND FOR SUMP PUMP CONTAINER

BACKGROUND OF THE INVENTION

1. Field of the Invention:

This invention relates to pump stand inserts for sump pump containers or sump liners which are sub-floor reservoirs for the reception of ground water which seeps into basements or other subterranean rooms. Generally the water is channeled to the sump reservoir and then pumped therefrom by a sump pump via a discharge conduit to an exterior location.

2. Description of the State of the Art:

Sump pump containers or sump liners are designed for use in water control systems of the types disclosed in my prior U.S. Pat. No. 5,314,313, 5,501,044, and 5,927,955 for example.

In such systems, the sump pump container is a reservoir for the reception of the water seepage which is channeled thereto, and the conventional sump pump contained therewithin includes a water-level actuated lever arm switch which energizes the pump to discharge the water from the container whenever the water level reaches a predetermined height, as sensed by a float attached to the lever arm.

The size of the sump pumps incorporated within the sump liner container will vary depending upon the requirements of different installations and/or whether a battery-operated secondary pump is included to assure evacuation in the event of a power failure. If the sump pumps are too close to each other on the inner floor of the container their lever arms and floats can engage each other, the other pump, or the wall of the container and become inoperative. In such cases the container fills and overflows into the basement before the occupant becomes aware that a problem exists, unless the system is provided with a water level-sensing alarm as disclosed in my U.S. Pat. No. 5,314,313.

In the case of conventional sump containers for holding two sump pumps, generally an AC-powered pump and a battery-operated pump, the diameter of the floor of the container may be too small to receive two pumps, side-by-side, without interference with each other and/or with the wall of the container.

It is known to incorporate a sump pump stand in a sump basket to elevate the pump above the floor of the basket to prevent mud and debris from entering the pump, and reference is made to U.S. Pat. No. 5,249,930 for its disclosure of such a pump stand. The pump stand of the reference is integral, has a sloped platform provided with circumferential openings, a central opening, supports for supporting the sump pump on the sloped platform, and legs for supporting the stand on the floor of the container basket.

SUMMARY OF THE INVENTION

The present invention relates to a novel pump stand for a sump pump container for overcoming or avoiding the aforementioned problems, and for adapting the sump container to receive and support two or more sump pumps at different elevations or at the same elevation above the floor of the container where the diameter of the frustoconical container is sufficiently greater than the diameter of the floor of the container to accommodate the two pumps, side-by-side, sufficiently-spaced from each other and from the wall of the container to prevent interference.

The present pump stand is an integral unit comprising a level, somewhat-circular platform having at least four spaced peripheral legs and at least two closely-spaced central legs, and a partition line on the platform for bisecting the pump stand into two similar half-stands, each having at least two peripheral legs and at least one central leg, which half-stands are stackable upon one another to support a sump pump at a greater elevation within a sump container, if desired.

THE DRAWINGS

DETAILED DESCRIPTION

Figure 3:
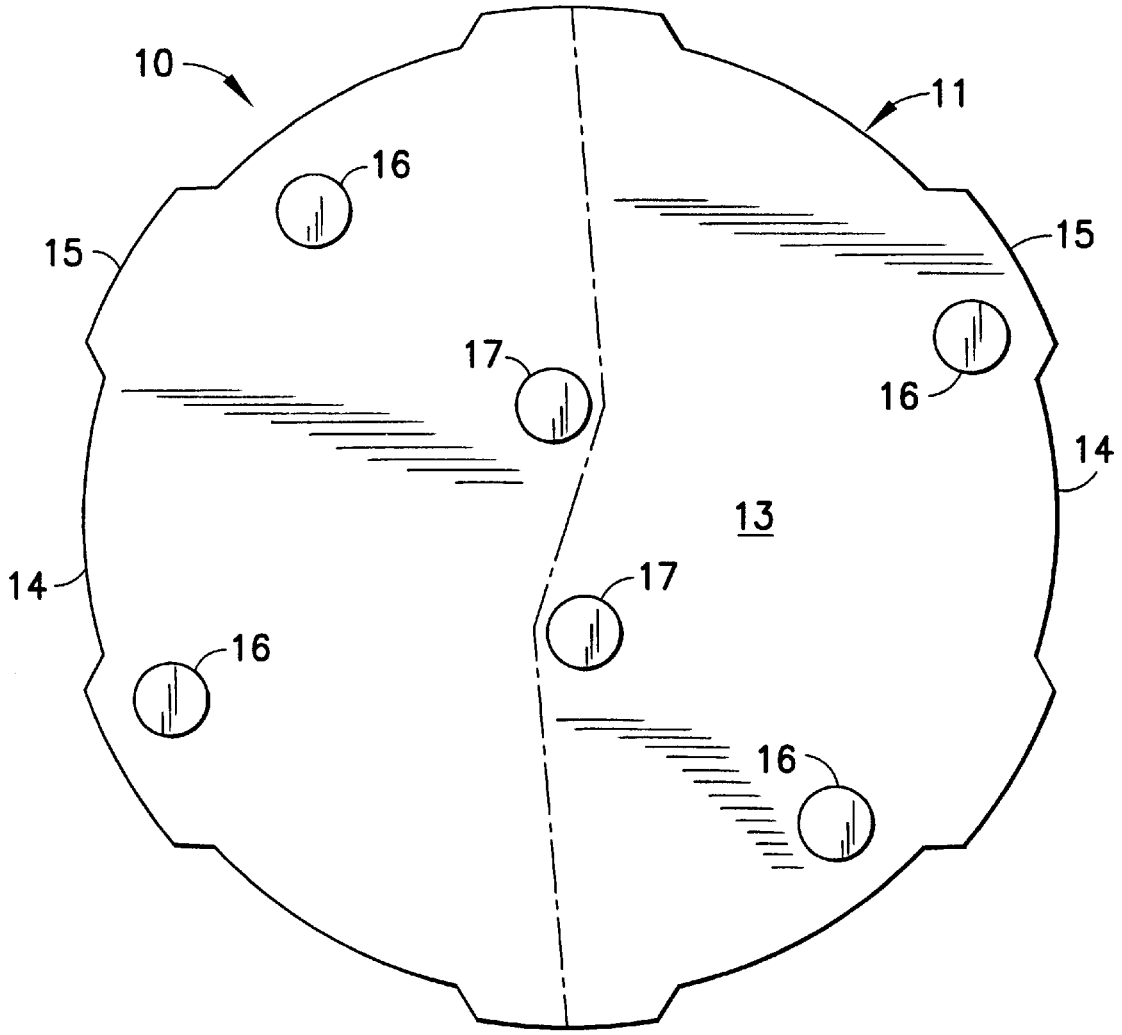
FIG. 3 is a view of the underside of the pump stand of FIG. 1.

Referring to the pump stand embodiment illustrated by FIG'S 1 to 3 of the drawing, the stand 10 comprises a level, somewhat-circular platform 11 formed of plastic or other sturdy water-resistant material which is sufficiently strong to support the weight of two or more sump pumps and which can be broken or cut into two similar, self-supporting half-stands. The platform 11 has an upper surface 12 and an under surface 13, shown in FIG. 3. The somewhat-circular periphery of the platform 11 is provided with a spaced plurality of cutouts or indentations 14 separated by spaced extensions 15. The diameter of the platform 11 between opposed extensions 15 approaches the inner diameter of the sump container, into which the pump stand is to be inserted, at the height of the platform 11 above the floor 21 of the container 20. The purpose of the indentations 14, around the periphery of the platform 11, is to permit the free circulation of inlet water and sump water from below and above the platform for actuation and deactuation of the sump pump.

The stand 10 is provided with a plurality of spaced peripheral legs 16, preferably four tubular legs 16 as illustrated, and a plurality of central legs 17, preferably two tubular legs 17 as illustrated. The peripheral legs 16 and central legs 17 are formed from material, such as plastic, which is breakable or cutable, and the legs are provided with break lines or cut lines which enable the user to shorten all of the legs to the same extent if it is desired to reduce the height of the platform above the floor 21 of the sump container 20 into which the stand 10 is placed, or above the upper surface 12 of the platform 11 on which the half-stand 25 is stacked as illustrated by FIG. 4.

The legs 16 and 17 are secured to the undersurface 13 of the platform 11 and extend substantially vertically downwardly so as to engage the floor 21 of the container 20 or the surface 12 of the lower stand 10 without interference with the interior wall 22 of the container.

Figure 1:
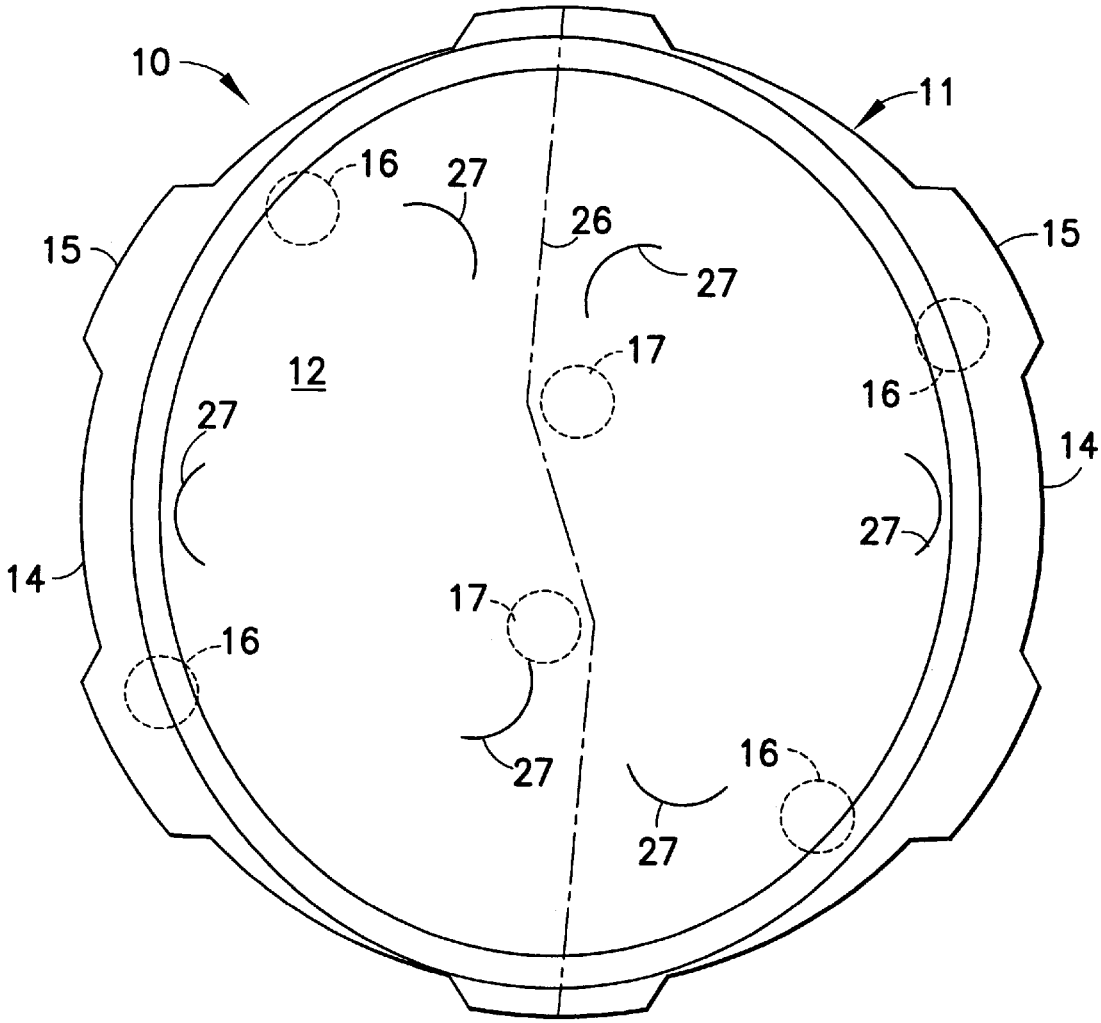
FIG. 1 is a plan view of a pump stand according to the present invention.
Figure 2:
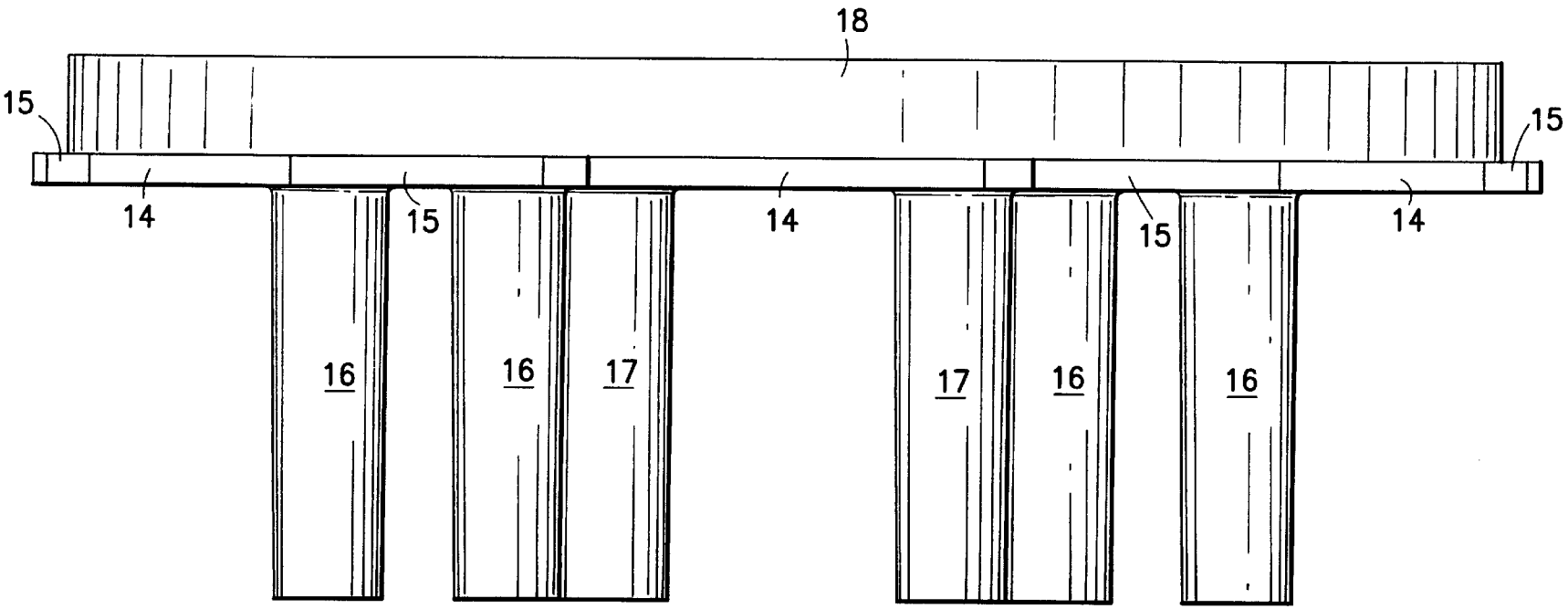
FIG. 2 is a side view of the pump stand of FIG. 1.

According to a preferred embodiment the present stand 10 is provided with an upper peripheral retainer ring or raised stop wall 18 for preventing outward movement of the pump(s) positioned on the stand into engagement with the inside wall 22 of the container 20, similar to the floor ring of my U.S. Pat. No. 5,927,955, also shown as 18*a* in FIG. 4. The present narrow stop wall 18 is about one inch in height and is out-of-round or somewhat eliptical, as shown in FIG. 1, in order to accommodate two pumps.

Figure 4:
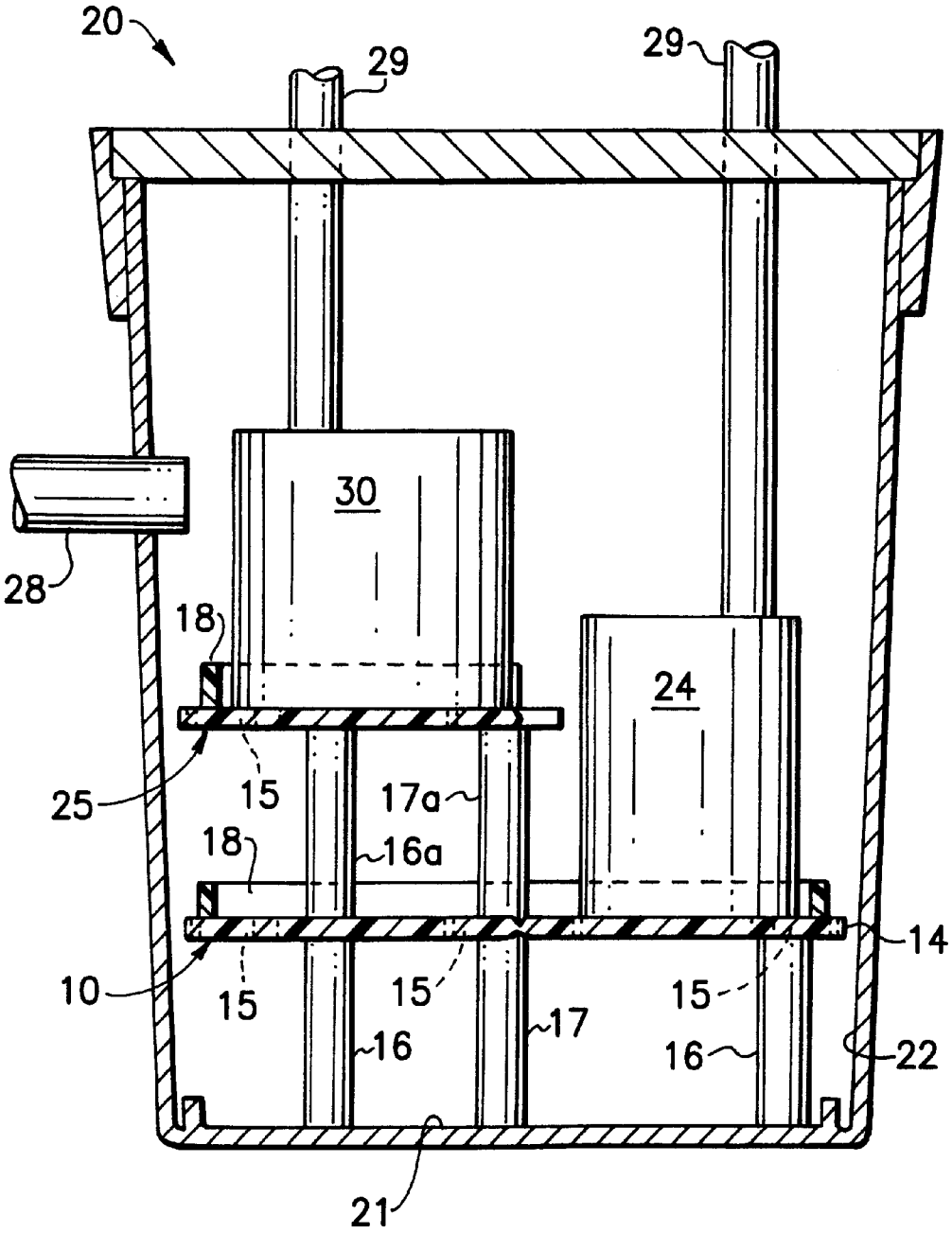
FIG. 4 is a cross-section of a sump pump container housing two sump pumps one supported on a half-stand stacked upon a full stand supporting the second sump pump.

FIG. 4 of the drawings illustrates a unitary full stand 10 supporting a lower sump pump 24 having a discharge conduit 29, and also supporting a half-stand 25 which in turn supports an upper sump pump 30, also having a discharge conduit 29. The half-stand 25 is produced by breaking or cutting a full stand 10 along a weakened severing line or partition line 26, shown in FIGS. 1 and 3, to produce two similar self-supporting tripod half-stands 25, each having two peripheral legs 16 and one inner leg 17. If desired, a half-stand 25 can be inserted into a sump container 20 to support a large sump pump above the floor 21 while a second smaller sump pump is supported on the floor 21 next to the half-stand 25. This is particularly useful in situations where the inner diameter of the container 20, adjacent the floor 21, cannot accommodate the two pumps side-by-side because of their sizes.

Frequently it is desired to elevate the pumps above the dirt or silt accumulation on the floor 21 of the sump container 20 and/or to raise the actuation position of one or both pumps. In such cases the present pump stand 10 may be used to support one or two sump pumps above the floor 21 of the container, and the legs 16 and 17 can be uniformly shortened, if desired, to reduce the degree of elevation of the platform 11 above the floor 21 of the container and to prevent blockage of the sump pump by dirt and mud accumulated on the container floor 21. Also, the pumps and stands can be removed periodically to permit removal of the dirt and mud from the floor 21, after which the pumps and stands can be replaced.

Rather than illustrating each of the many possible stocking arrangements and pump combinations within the present invention, FIG. 4 is given as an illustration of an arrangement which includes a full stand 10 with full legs 16 and 17 and a half-stand 25 having half-legs 16*a* and 17*a* stacked thereon, each supporting a sump pump 24 and 30, respectively. It will be apparent to those skilled in the art that stand 10 may be used along, either with full or half-legs, to support 1 or 2 pumps above the floor 21 of the container 20, or that two full stands 10 can be stacked to elevate the pump(s) further above the floor 21, or that a half-stand 25 can be used alone, with full or half-legs, to support one pump above the floor 21, adjacent a floor-supported pump.

Preferably the upper surface 12 of the platform is provided with indicia 27, which can be raised retainers or stop members, shown in FIG. 1, to locate the proper position of the base of the sump pumps during initial assembly and/or to fix their position on the platform against vibrational movement of its float into interference with the inner wall 22 or with the float of an adjacent pump, and to guide the installer as to the exact position(s) of the pump(s) being positioned on the stand. This is important because, with two pumps installed within the sump container in view of their proximity to each other and to the wall of the container in order to prevent interference of their actuation ever switches.

It will be apparent to those skilled in the art, in the light of the present disclosure, that the upper surface 12 of the present stands 10 may be provided with pads or recesses to receive the bases of the stand legs 16 and 17 to fix and stabilize the positions of the legs of one stand 10 or half-stand 25 stacked upon another.

As illustrated by FIG. 4, the spaced extension areas 15 of the platform 11 are closely spaced from, and may even engage, the inner surface 22 of the container 20, but the spaced recessed areas 14 of the platform 11 provide open water-circulation areas which enable the water level to rise freely within the container 20 as water is admitted through the inlet conduit 28 and from the ground through holes in the sidewall of the sump container 20. Also, the spaces 14 combine with the pump ring or wall 18 so that any mud or sand washing in from the ground through weep holes in the sump container 20, above the elevation of the platform 11, will not accumulate on the platform 11 but will wash down below the platform and settle on the floor 21 at the bottom of the sump container 20, from which it can be removed periodically if necessary. The stand 10 elevates the pump 24 well above the floor 21 to avoid plugging of the pump with dirt, mud or other solids which may enter the container 20.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A stand for supporting sump pumps within a sump container at an elevation above the floor of the container, comprising a substantially circular platform having a partition line on a surface thereof for separating said platform into two substantially semi-circular half-platforms, a plurality of spaced peripheral legs attached to the undersurface of said platform, and a plurality of closely-spaced central legs attached to the undersurface of said platform, adjacent the center thereof, whereby said stand can support two sump pumps, side-by-side, or can be partitioned along said partition line to produce two half-stands, each half-stand having at least two peripheral legs and at least one central leg for supporting a single sump pump within a sump container adjacent an interior wall thereof.

2. A stand according to claim 1 in which all of said legs are provided with partition lines to enable the legs to be shortened to the same reduced length, if desired.

3. A stand according to claim 1 in which an upper surface of said platform is provided with spaced indicia as guides to indicate the installation position of the sump pumps to be mounted thereon, to avoid interference with each other during operation.

4. A stand according to claim 1 in which an upper surface of said platform is provided with spaced retainers designed to engage a base of a supported sump pump and restrain the pump against excessive vibrational movement.

5. A stand according to claim 1 in which an upper surface of said platform is designed to support the bases of the legs of a similar stand or half-stand stacked thereon.

6. A stand according to claim 1 in which the upper surface of said platform is provided with a raised peripheral retainer wall to restrain supported sump pumps against vibrational movement into engagement with the interior wall of the sump container.

7. A stand according to claim 1 in which said partition line is a weakened area which enables the platform to be broken into two half-platforms.

* * * * *